US005893707A

United States Patent [19]

Simmons et al.

[11] Patent Number: 5,893,707

[45] Date of Patent: Apr. 13, 1999

[54] PNEUMATICALLY SHIFTED RECIPROCATING PUMP

[76] Inventors: John M. Simmons, 605 Slayton; Tom M. Simmons, 504 Slayton, both of Saginaw, Mich. 48603; David M. Simmons, 6523 Stroebel Rd., Saginaw, Mich. 48609

[21] Appl. No.: 08/810,868

[22] Filed: Mar. 5, 1997

Related U.S. Application Data

[60] Continuation-in-part of application No. 08/711,202, Sep. 10, 1996, abandoned, which is a division of application No. 08/548,847, Oct. 26, 1995, Pat. No. 5,558,506, which is a continuation-in-part of application No. 08/205,702, Mar. 3, 1994, abandoned.

[51] Int. Cl.[6] ..... F04B 17/00

[52] U.S. Cl. ..... 417/393; 417/394; 91/230

[58] Field of Search ..... 417/384, 392, 417/393, 394, 401; 91/230

[56] References Cited

U.S. PATENT DOCUMENTS

| | | | |
|---|---|---|---|
| 1,161,787 | 11/1915 | Nickol . | |
| 2,239,727 | 4/1941 | Mayer | 103/52 |
| 2,428,917 | 10/1947 | McFarland | 417/393 |
| 2,467,413 | 4/1949 | Wilkhack | 417/401 |
| 3,081,794 | 3/1963 | Lucien | 137/622 |
| 3,362,618 | 1/1968 | Fortinov | 417/401 |
| 3,749,127 | 7/1973 | Beeken | 137/625.6 |
| 3,773,083 | 11/1973 | Hague | 137/625.69 |
| 3,791,768 | 2/1974 | Wanner | 417/393 |
| 4,203,571 | 5/1980 | Ruchser | 251/31 |
| 4,496,294 | 1/1985 | Frikker | 417/393 |
| 4,566,867 | 1/1986 | Bazan | 417/393 |
| 4,634,350 | 1/1987 | Credle, Jr. | 417/393 |
| 4,655,378 | 4/1987 | DuFour | 226/23 |
| 4,736,773 | 4/1988 | Perry | 137/625.64 |
| 4,836,756 | 6/1989 | Fukimoto | 417/394 |
| 4,902,206 | 2/1990 | Nakazawa | 417/394 |
| 4,927,335 | 5/1990 | Pensa | 417/393 |
| 4,983,104 | 1/1991 | Kingsford | 417/473 |
| 5,060,694 | 10/1991 | Florida | 137/625.18 |
| 5,174,731 | 12/1992 | Korver | 417/393 |
| 5,222,521 | 6/1993 | Kihlberg | 137/625.69 |
| 5,224,841 | 7/1993 | Thompson | 417/392 |
| 5,238,372 | 8/1993 | Morris | 417/393 |
| 5,252,042 | 10/1993 | Yonezawa | 417/401 |
| 5,326,234 | 7/1994 | Versaw | 417/393 |
| 5,484,269 | 1/1996 | Vick | 417/401 |
| 5,558,506 | 9/1996 | Simmons et al. | 417/393 |

*Primary Examiner*—Timothy S. Thorpe
*Assistant Examiner*—Ted Kim
*Attorney, Agent, or Firm*—Prince, Yeates & Geldzahler

[57] ABSTRACT

A pneumatically actuated reciprocating fluid pump and spool valve combination is pneumatically shifted by pressurized air that exhausts from a respective pressurized bellows, diaphragm, or piston chamber, as the bellows, etc. nears the end of its pressure stroke (the exhaust stroke of the pumped fluid). This pressurized air exhausts from the bellows chamber via a shift piston and canister mechanism that seals on the face of the shift canister, rather than on its periphery. The pressurized air exhaust from the bellows chamber acts on the end of the valve spool element to shift the spool element to its opposite position, which reverses the application of pneumatic pressure and atmospheric exhaust between the two bellows chambers to actuate the reciprocating pump.

17 Claims, 6 Drawing Sheets

PNEUMATICALLY SHIFTED RECIPROCATING PUMP

CROSS-REFERENCE TO RELATED APPLICATIONS

This application is a Continuation-In-Part of U.S. Serial No. 08/711,202, filed Sep. 10, 1996, now abandoned which is a Divisional application of U.S. Ser. No. 08/548,847, filed Oct. 26, 1995, now U.S. Pat. No. 5,558,506, which is a Continuation-In-Part of U.S. application U.S. Ser. No. 08/205,702, filed Mar. 3, 1994, now abandoned.

BACKGROUND OF THE INVENTION

1. Field of the Invention

The present invention relates to a reciprocating fluid pump, and more particularly relates to a reciprocating fluid pump and spool valve combination for shifting pneumatic pressure between reciprocating pistons in the pump in order to effect pumping.

2. Description of the Prior Art

Reciprocating pumps are well known in the fluid industry. Such reciprocating fluid pumps are operated by a reciprocating spool valve which shifts pressurized air from one pumping chamber of the pneumatic reciprocating pump to the other as the pumping means (piston, bellows, diaphragm, etc.) reaches the end of its pumping stroke. The valve spool element in the spool valve shifts between two positions which alternately supply pressurized air to the pumping means of one side of the pump while simultaneously permitting the other pumping means to exhaust the air therefrom. The shifting of the valve spool element simply alternates this pressurized air/exhaust between pairs of pumping means within the pneumatic pump, thereby creating the reciprocating pumping action of the pump.

In conventional pneumatic reciprocating pump and spool valve combinations, the valve spool elements have been shifted mechanically or electronically. In mechanical shifting, the spool valve itself is typically constructed as an integral part of the reciprocating pump in a manner such that when the pump piston or diaphragm reaches the end of its pumping stroke, it engages a shift mechanism to mechanically shift the valve spool of the spool valve to its opposite position, which reverses the pressurized air and exhaust to the two reciprocating pumping means in order to reverse the direction of both pumping means to cause the just-exhausted fluid chamber to draw fluid thereinto and simultaneously exhaust (pump) fluid from the opposite full fluid chamber.

In electronic shifting of such a pneumatic reciprocating pump, the mechanical shifting means for the spool valve is replaced with an electric switch or switches which then activate a solenoid operated spool valve for effecting shifting of the valve spool in response to the reciprocating pump pistons', bellows', or diaphragms' having reached the end of their pumping strokes.

A third type of shifting of the spool valve is pneumatic shifting, wherein the pump pistons, bellows, diaphragms, etc. engage mechanical or electrical switches at the end of their respective strokes, which shift the supply air pressure to either end of the valve spool for shifting between positions. In the case of electrical switches, these electrical switches actuate solenoid valves which reciprocate the supply air pressure to the spool valve. A variation of this pneumatically shifted spool valve utilizes pressurized air on both ends of the valve spool, the shifting being effected by the electrical or mechanical switch to release the pressurized air from alternating ends of the valve spool to permit pressurized air at the opposite end to shift the valve spool.

One pneumatically operated reciprocating diaphragm pump on the market today is controlled by a mechanically shifted reciprocating rod that, in turn, causes an internal valve spool within the pump to shift to alternate the applications of pressurized air and exhaust to opposing diaphragm chambers within the pump. The initial shifting mechanism (reciprocating rod) is mechanical, in that it is shifted by being alternately struck on its ends by the two reciprocating fluid pump diaphragms. The alternating rod removes lateral support from a flexible inner sleeve that permits direct pressurized air to bleed around the sleeve to an end surface of the valve spool for shifting the valve spool to its opposite position. Reciprocation of the valve spool reverses the application of pressurized air and exhaust in the reciprocating pump diaphragm chambers in order to effect pumping of the pump, as is customary in all pneumatically operated dual reciprocating diaphragm or bellows-type pumps that are spool valve-actuated.

A similar type of pneumatically actuated reciprocating pump utilizes a spool valve incorporated into the pump body, the spool valve, of course, for reversing pressurized air and exhaust between the two opposed pumping chambers. The pumping chambers comprise connected diaphragms, which diaphragms alternately engage the end of a shifting rod to reciprocate it between left and right positions. The reciprocating shifting rod alternates air pressure and exhaust between the ends of the valve spool to reciprocate the valve spool. Reciprocation of the valve spool, of course, operates the reciprocating pump.

There are many problems associated with the currently available pneumatic reciprocating pumps and spool valve shifting mechanisms. Mechanical shifting of the spool within the spool valve is limited because of available space inside the reciprocating pump, and is also susceptible to premature wear and failure of either the mechanical shifting device for the spool valve, the pump diaphragm or piston itself, or both.

The use of electronics or electrical switching of the spool valve is prohibited in many situations because of the potential for spark and fire hazards generally associated with electric (i.e., spark generating) switching devices, not to mention the complexity that is introduced by the addition of an electric power supply, electrical switches, and solenoid-controlled pneumatic valves.

Some types of pneumatic switching of spool valves in reciprocating fluid pump mechanisms are also a potential source of problems. By providing air pressure to both sides of the spool within the spool valve, the spool has a natural tendency to locate itself in the exact center of the valve when air pressure to the pump is turned off. When it is again attempted to start the pump, the valve spool, being in the exact center of the spool valve, will not direct pneumatic pressure to either side of the valve pumping mechanisms. Therefore, the pump will not be able to start up. This is known in the industry as "deadhead." Deadhead can also occur in mechanical spool valve switches whenever switches on both sides of the pump trip during the same stroke. This can be due to a number of reasons including positive fluid pressure through the pump, the presence of a solid material within the pumped fluid, pneumatic leaks, and of course, mechanical switch malfunction. Air in the pumped fluid within the pumping chamber can also create deadhead problems.

The previously described pneumatically actuated reciprocating diaphragm pump that is actuated by an internal valve spool is difficult to adjust and control, because of the use of the internal deforming sleeve. The valve spool is shifted because the plastic sleeve deforms because it loses its lateral support when the control rod shifts. In theory, when air pressure against the sleeve reaches a predetermined amount, the sleeve will deform, eliminating the air pressure seal between the sleeve and valve spool, causing pressurized air to escape to the end surface of the valve spool to shift it to its opposite position. Because the deformation of the sleeve is so dependent upon a number of external factors (temperature, humidity, presence of lubricants or other chemicals, etc.), it is extremely difficult to predict when and how much the plastic sleeve will deform, and therefore when and how rapidly the valve spool will shift. In addition, constant flexure of the plastic sleeve will create material fatigue brittleness, etc. rendering the sleeve valueless for its intended purpose.

Prior art pneumatically actuated reciprocating fluid pumps have also consistently had problems with pumped fluid surge as pumped fluid from one chamber abruptly stops and fluid from the opposite chamber abruptly starts. This surge causes what is termed hydraulic hammering in supply lines, that tends to vibrate the lines, resulting in unnecessary abrasion, flexure, and fatigue in the lines, and also tends to vibrate the fluid connections and fittings loose near the pump. In certain applications, surge can dislodge particulate contamination within fluid filters and reintroduce this contamination into the fluid system.

OBJECTS OF THE INVENTION

It is therefore an object of the present invention to provide a pneumatically shifted reciprocating pump which is virtually immune to deadhead.

It is a further object of the present invention to provide a pneumatically shifted reciprocating pump which eliminates the need for separate electric or mechanical switches for shifting the associated spool valve.

It is a still further object of the present invention to provide a pneumatically shifted spool valve which operates on air taken from the pressurized side of a pneumatic reciprocating pump to operate the shifting of the spool valve, without the requirement for the provision of an additional air supply source.

It is a still further object of the present invention to provide a pneumatically shifted reciprocating fluid pump that eliminates the need for separate electrical or mechanical shifting of the spool valve for reciprocating pneumatic air pressure to the reciprocating pump pumping chambers.

It is a still further object of the present invention to provide a pneumatically shifted spool valve which may be intertimed and synchronized with multiple spool valves or a multiple stage spool valve and multiple pumps, or multiple chamber pumps, by overlapping the strokes of reciprocating pumps, in order to reduce the surge inherent in reciprocating pumps.

SUMMARY OF THE INVENTION

A pneumatically shifted reciprocating fluid pump is shifted by a pneumatically shifted shuttle or spool valve, the spool valve shifting to reciprocate the pumping means of the pump by reciprocating pneumatic pressure within the pump. The reciprocating pump shifting mechanism comprises a shifting piston and canister mechanism attached to the reciprocating pump piston, bellows, diaphragm, or other pumping element. The canister fits within a blind bore in the pump head, the end of the canister sealing against the end of the bore. Air pressure within the pumping chamber retains the canister in sealing engagement against the blind bore end until the pumping stroke of the pump piston, bellows, diaphragm, etc. causes the canister to "unseat" from the blind bore end, thereby permitting motive fluid (pressurized air) to escape from the pumping chamber to shift the spool valve spool when the reciprocating pump pumping means (piston, bellows, diaphragm, etc.) reaches a predetermined location in its pumping (evacuation) cycle. The pump shifting piston and canister mechanism is designed so that the canister seals on its end or "face", rather than its side (circumference or periphery). By sealing on the end of the canister rather than the periphery, the sealing canister can be machined with less dimensional tolerance required (greater play permitted) between the canister periphery and pump head bore, thereby resulting in reduced manufacturing costs.

The spool valve is also designed so that the valve spool seals on the ends (faces) of the spool element, rather than the sides (circumference or periphery) of the spool. By sealing on the ends of the spool element rather than the periphery, the spool element can also be machined with less dimensional tolerance required (greater play permitted) between the spool element periphery and valve body bore, thereby resulting in reduced manufacturing costs. Because the spool element seals on its ends, lateral wear on the spool element circumference and valve body bore are irrelevant and do not affect valve performance.

DETAILED DESCRIPTION OF THE INVENTION

Figure 1:
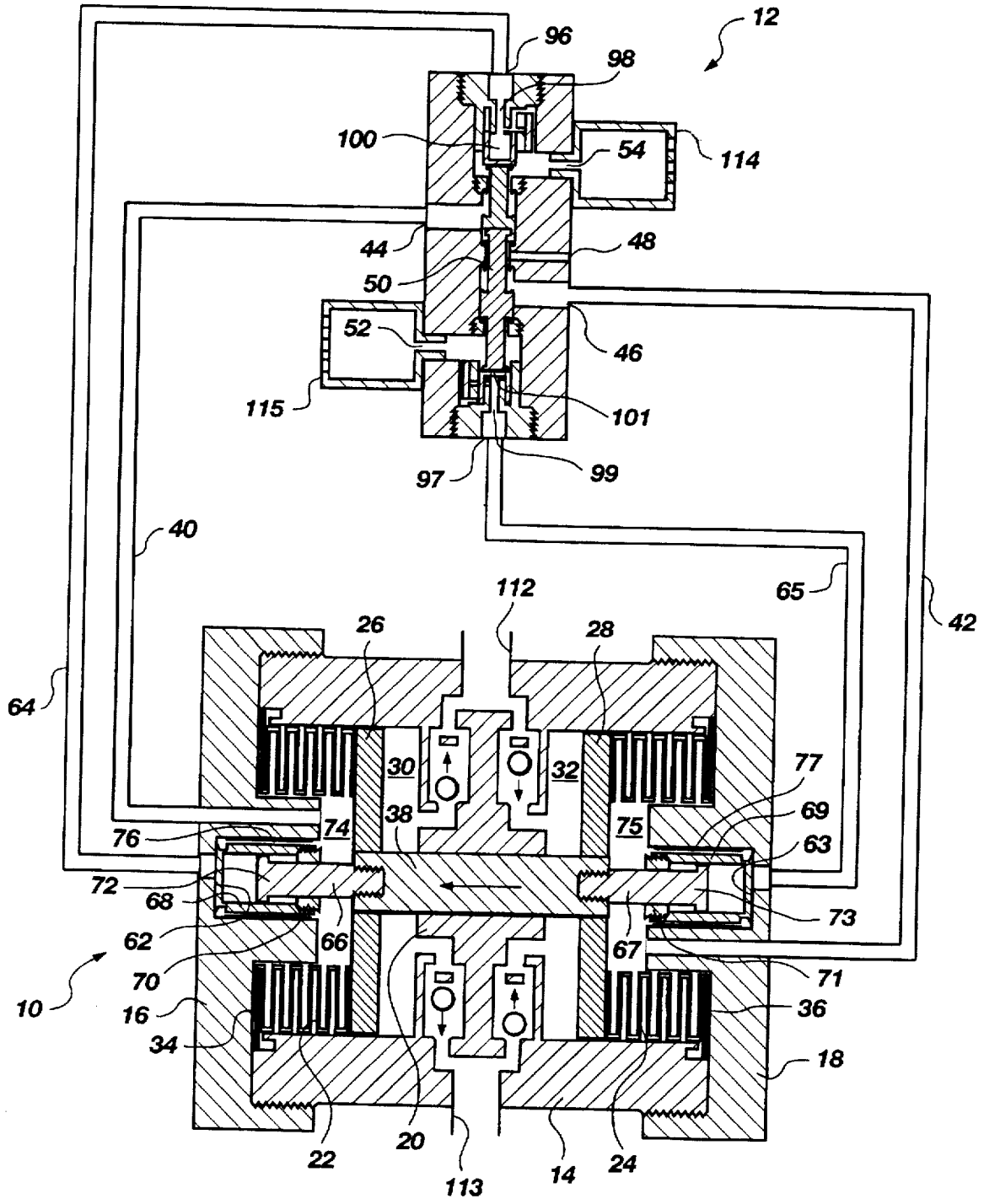
FIG. 1 is a schematic drawing of the pneumatically shifted reciprocating fluid pump and pneumatically shifted spool valve, both shown in section, illustrating the pump and spool valve in a first of four sequential pumping cycles.

Turning now to the drawings, and initially to FIG. 1, a pneumatically actuated, dual opposed-bellows reciprocating fluid pump 10 and its associated spool valve 12 are shown schematically and in section to more easily understand the structure and operation. The reciprocating fluid pump 10 is, in essence, a conventional, 4 cycle, 2 stroke, dual reciprocating-bellows pump actuated by pneumatic positive air pressure. The fluid pump comprises a housing 14 to which are attached respective left- and right-end pump heads 16, 18. The pump housing 14 also includes a central section 20 that includes the unidirectional flow mechanisms for admitting the fluid to be pumped into the fluid pump and directing the pumped fluid out of the pump. These unidirectional flow mechanisms are shown schematically as floating ball-type check valves, but, of course, may be any form of unidirectional flow mechanism that functions to channel pumped fluid in one direction through the fluid pump. For purposes of reference, fluid flow through the fluid pump 10 is from bottom to top in the drawings.

The fluid pump 10 includes identical, reciprocating left and right bellows 22, 24, respectively, that are attached to respective left and right fluid pumping pistons 26, 28. These respective pistons 26 and 28, in combination with the pump central section 20, define respective left and right fluid pumping chambers 30 and 32. The ends of the bellows opposite the pistons (the outboard ends) are illustrated at 34 and 36, respectively, and are attached to the outboard ends of the fluid pump housing 14 at respective left and right pump heads 16 and 18, in a manner to form effective fluid seals between the respective bellows ends and fluid pump housing/pump head attachments. The two fluid pumping pistons 26, 28 are connected together by a connecting rod 38 which enables the pistons to slide and reciprocate together within the fluid pump housing in a customary manner.

The fluid pump is actuated by pneumatic pressure provided by respective left and right pneumatic air supply lines 40 and 42, which alternately introduce pressurized air into the left and right bellows chambers from the spool valve 12 in a timed fashion to alternately expand the bellows to provide the reciprocating fluid pumping action of the pump. This alternating pneumatic pressure is provided by the spool valve 12 at respective left and right pneumatic air supply ports 44 and 46.

The spool valve (more clearly shown in FIG. 5) directs pneumatic air pressure from an air inlet port 48 alternately between the left and right air supply ports 44, 46 by the action of the valve spool 50 alternately shifting between its upper and lower positions. In addition, the spool valve includes respective left and right exhaust ports 52, 54, which are adapted to exhaust air from the chamber of the bellows being compressed at the same time that air pressure is being fed to the opposite bellows chamber to expand same. This reciprocating pressurized air supply and exhaust is performed by the spool valve.

Figure 6:
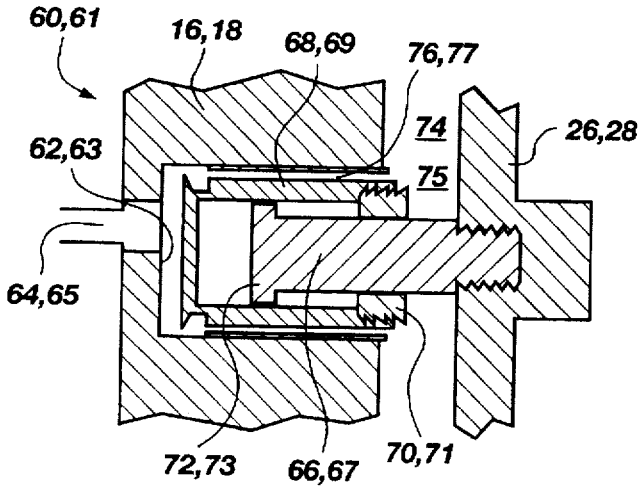
FIG. 6 is a partial sectional view of the fluid pump piston and canister shifting mechanism of the present invention.

FIG. 6 is a partial sectional view of the fluid pump piston and canister shifting mechanism of the present invention. FIG. 6 illustrates the left shifting mechanism 60. It should be understood that the right shifting mechanism 61 is identical thereto and functions in a manner which is identical therewith. The piston and canister shifting mechanism 60 is adapted to reciprocate within a blind bore 62 formed in the left pump head 16. The blind bore 62 communicates with a left shift line 64 for supplying pressurized blasts of air to the spool valve 10.

FIG. 6 illustrates the respective left and right shifting piston and canister mechanisms 60 and 61 connected to respective fluid pumping pistons 26, 28, and fitted into respective pump housing pump heads 16, 18. These shifting mechanisms comprise respective left and right shifting pistons 66, 67 that reciprocate within respective left and right shifting canisters 68, 69. As shown, respective shifting pistons 66, 67 are connected to respective fluid pumping pistons 26, 28 in order to travel linearly therewith. Also, of course, respective shifting pistons 66, 67 reciprocate within respective shifting canisters 68, 69 in order to effect timed reciprocation of the valve spool 50 to cause the spool valve air supply to actuate the reciprocating fluid pump.

Each shifting canister includes a respective canister cap, 70 on the left and 71 on the right, that retain respective shifting pistons therein. Each shifting piston 66, 67 includes an increased diameter head 72, 73 that reciprocates within its respective shift canister 68, 69 to cause its respective shift canister to "shift", thereby releasing shifting air from respective bellows chambers 74, 75 to respective left and right shift lines 64, 65. Each shift canister 68, 69 includes a plurality of shift air passageways 76, 77 that serve to permit pressurized air flow therethrough from respective bellows chambers to respective shift lines 64, 65, upon appropriate shifting of each canister, as will be explained in greater detail hereinbelow. In addition, the shift canisters 68, 69 fit loosely within their respective bores 62, 63 in respective pump heads 16, 18, which also permit pressurized air flow there around upon the shift. As will be explained in greater detail hereinbelow, each time pressurized air is released from bellows chambers 74, 75 into a respective shift line 64, 65, this air pressure functions to shift the valve spool 50 to its opposite position within the valve, in order to shift (i.e., reverse) the applications of pneumatic pressure and exhaust between the interiors of respective bellows chambers 74 and 75.

Turning again to FIG. 5, the spool valve 12 is shown for use with the pneumatically actuated reciprocating fluid pump. The spool valve 12 comprises a valve body 80 defining the left and right air supply ports 44, 46, air inlet port 48, and left and right exhaust ports 52, 54. The valve spool 50 reciprocates within a spool bore 82. The valve spool 50 has two valve elements 84 and 86, that function to reciprocate the air pressure and exhaust between respective air supply ports 44, 46, and therefore between the fluid pump bellows chambers. The valve spool specifically is loose-fitting within the valve body, sufficient to permit a slight amount of pressurized blow-by around the two valve elements, for purposes to be explained in greater detail hereinbelow.

As shown, the valve spool elements 84, 86 are designed to seal at their respective ends 88, 90, 92, 94 against sealing faces 89, 91, 93, 95 formed in the valve body, rather than seal around their peripheries. Specifically, when air pressure at the upper shifting port 96 shifts the valve spool 50 to its down position shown in FIG. 5, the bottom end 94 of the lower spool element 86 seals against the valve body sealing face 95, to interrupt communication between the right air supply port 46 and the left exhaust port 52, and the bottom end 90 of the upper spool element 84 seals against the valve body sealing face 91, to interrupt communication between the inlet port 48 and the left air supply port 44. Likewise, when air pressure at the lower shifting port 97 shifts the valve spool 50 to its upper position shown in FIGS. 2 and 3, the top end 88 of the upper spool element 84 seals against the valve body sealing face 89, to interrupt communication between the left air supply port 44 and the right exhaust port 54, and the top end 92 of the lower spool element 86 seals against the valve body sealing face 93, to interrupt communication between the inlet port 48 and the right air supply port 46. Because the spool elements seal on their ends or faces rather than their peripheries, the spool elements can be machined with less dimensional tolerance required (greater play permitted) between the spool element peripheries and valve body bores, thereby resulting in reduced manufacturing costs. Also, because the spool elements seal on their ends, lateral wear on the spool element circumference and valve body bore are irrelevant and do not affect valve performance. In addition, materials having different coefficients of thermal expansion can be used for the valve body and valve spool.

The spool valve 12 includes respective upper and lower shifting ports 96, 97 which are adapted to receive alternate blasts of pressurized air in order to reciprocate the spool within the valve. These shifting ports 96, 97 communicate with respective upper and lower shifting ducts 98, 99 which in turn, communicate with respective upper and lower push cap chambers 100, 101. Respective upper and lower push caps 102, 103 engage distal ends of respective valve spool upper and lower sections (not numbered), and reciprocate within respective annular channels 104, 105 in respective valve body outer sealing plugs 106, 107. As shown, each shifting duct 98, 99 and corresponding annular channel 104, 105 also communicate with respective right and left spool valve exhaust port 54, 52, through respective exhaust bleed orifices 108, 109, the purpose of which will be explained in greater detail hereinbelow with reference to the operation of the reciprocating fluid pump.

Those skilled in the art will appreciate that the pneumatic spool valve of the present invention cannot be manufactured having a unitary body and unitary spool, by virtue of the fact that the valve spool elements 84, 86 seat on their ends, rather than on their peripheries. Therefore, it should be obvious that only the interior-most valve body sealing faces 91 and 93 can be formed in the valve body. The two additional sealing faces 89 and 95 are therefore formed in separate upper and lower sealing caps 110, 111 that threadedly engage the valve body as shown.

Figure 7:
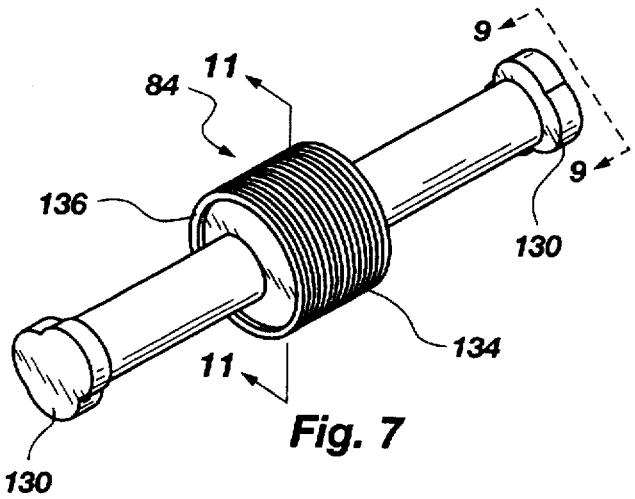
FIG. 7 is a perspective view of one section of the valve spool.

Also, the valve spool 50 must be manufactured in multiple pieces and assembled together during assembly of the spool valve. In this regard, FIG. 7 is a perspective view of the upper portion of the valve spool 50, and illustrates two aspects of the valve spool: (1) the cloverleaf interconnect between the upper and lower sections of the valve spool; and (2) the annular channels on the valve spool element 84, which will be explained in greater detail hereinbelow. FIG. 7 should be viewed in conjunction with FIG. 8, which is a perspective view of the lower section of the valve spool showing the lower valve spool element 86.

Figure 8:
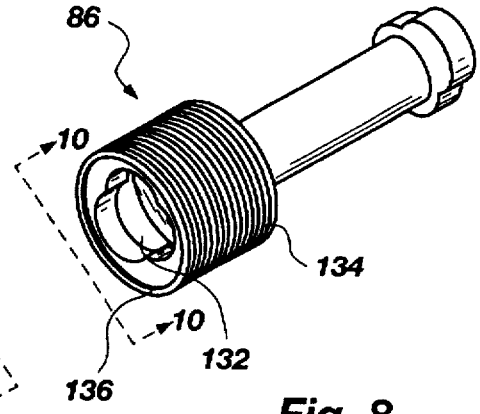
FIG. 8 is a perspective view of the other section of the valve spool that mates with the valve spool section of FIG. 7.
Figure 9:
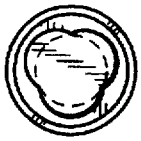
FIG. 9 is an end view of the cloverleaf interconnect of the valve spool section of FIG. 7, taken in the direction of arrows 9—9 in FIG. 6.
Figure 10:
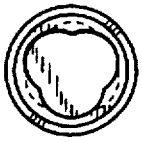
FIG. 10 is an end view of the mating cloverleaf interconnect of the other section of the valve spool of FIG. 7, taken in the direction of arrows 10—10 in FIG. 8.

Referring again to FIG. 7, the upper portion of the valve spool is formed with a unique male cloverleaf interconnect 130 on each end thereof that is adapted to mate with a female cloverleaf interconnect 132 formed in the lower valve spool element 86, shown in FIG. 8. The precise shapes of these cloverleaf interconnects are shown more clearly in FIGS. 9 and 10, respectively.

As those skilled in the art can appreciate, the valve spool 50 is assembled by inserting one of the valve spool sections into the valve body, and the other valve spool section into the opposite end of the valve body until the male cloverleaf interconnect 130 fits into the female cloverleaf interconnect 132. Rotating one section of the valve spool relative to the other approximately 60 degrees will "lock" the two valve spool sections together as one. Those skilled in the art will readily appreciate that, inasmuch as the upper and lower (i.e., outside) ends of the respective valve spool sections also include male cloverleaf interconnects, an installation tool having the same pattern as the female cloverleaf interconnect may be used to rotate the two valve spool sections together. With the valve spool 50 so installed in the valve body, the two sealing caps 110 and 111 (see FIG. 5) can now be installed in the valve body behind the respective valve spool elements 84, 86, followed by respective push caps 102, 103 and respective valve body outer sealing plugs 106, 107.

Figure 11:
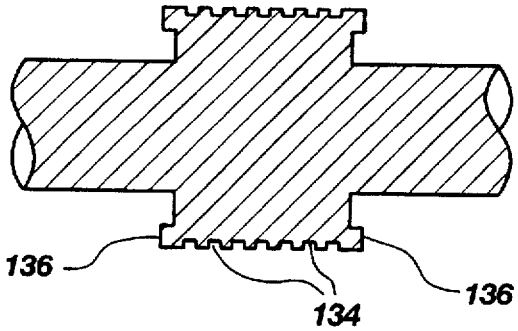
FIG. 11 is a sectional view of the valve spool of FIG. 7.

FIGS. 7, 8, and 11 also illustrate another aspect of the spool valve of the present invention, specifically, the circumferential or annular channels 134 around the respective valve spool elements 84, 86. As previously explained, because the fit between the valve body axial bore and valve spools is not tight, motive fluid (pressurized air) in the valve air inlet port 48 begins to pass around the respective "closed" spool element at the moment that the "closed" spool element begins to shift to its opposite position, as the pressurized air is being shifted between the left and right air supply ports 44, 46. As this pressurized air passes the respective spool element during this initial phase of the valve shift, the annular grooves 134 disturb the laminar air flow around the respective spool element, creating a drag-induced friction force between the annular surface of the spool element and the air flow. This friction force is created by the increase in the coefficient of drag around the spool element exterior surfaces, and has a tendency to assist the valve spool in shifting to its opposite position, until the valve spool reaches an approximate mid-point in its travel. Thereafter, the application of the greater air flow shifts to the opposite valve spool element, which is coming to rest to seat against the valve body seat sealing face (91 or 93), creating drag-induced friction force between the air flow and the "closing" valve spool element, tending to slow down and cushion the movement of the valve spool as it nears the end of its travel, thereby reducing impact damage to the spool element end seals and faces.

The inventors have determined that these annular grooves also function to eliminate any vibration of the valve spool inside the valve body, again by disrupting the laminar flow of air around an otherwise smooth surface.

The inventors have also determined that, by orienting the valve spool in a vertical orientation as shown in the drawings, the valve spool 50, always drops to the bottom of the valve body 80 when actuation air pressure at the inlet port 48 is terminated. In this manner, gravity causes the valve spool to reset to the same operable position upon shutdown, whereby pressurized air subsequently introduced at the spool valve air inlet port 48 will always pass around the valve spool 50, through the left air supply port 44 and into the pump left bellows chamber, to initiate pumping of the fluid pump. Because of the gravity reset of the valve spool 50, deadhead in the spool valve, and therefore the fluid pump, is always avoided.

OPERATION

With reference now again to FIGS. 1–4, the operation of the reciprocating fluid pump of the present invention will be explained. FIG. 1 illustrates the first stage or cycle of the pump and spool valve. The valve spool 50 is shown in its lower position (as in FIG. 5), having dropped within the valve body 80 under the force of gravity when air pressure is interrupted (when the pump is turned off). High pressure air is introduced to the spool valve at the air inlet port 48, and passes through the valve to the right air supply port 46, through the right air supply line 42, and into the right bellows chamber 75. Air pressure within the right bellows chamber 75 shifts the right shifting canister 69 to the right, sealing the interior of the right bellows chamber from the right shift line 65. With the right bellows chamber 75 sealed, it begins to fill under pneumatic pressure to expand, urging both fluid pumping pistons 26, 28 to the left. This is the pressure stroke of the right bellows 24 and exhaust stroke of the left bellows 22. The more back-pressure from the pumped liquid, the tighter the seal becomes between the right shifting canister 69 and the end of the right pump head blind bore 63.

Leftward movement of the right fluid pumping piston 28 evacuates (pumps) fluid from the right fluid pumping chamber 32, and out the fluid pump exhaust 112. Leftward movement of the left fluid pumping piston 26 draws fluid into the left fluid pumping chamber 30 via the fluid pump intake 113. Leftward movement of the left fluid pumping piston 26 also evacuates the left bellows chamber 74 through the left air supply line 40, the spool valve left air supply port 44, through the spool valve, out the right exhaust port 54 and through the right muffler 114, to atmosphere. The pressurization of exhaust air in the left bellows chamber 74 created by leftward movement of the left bellows 22 shifts the left shift canister 68 to the left to seal against the left pump head blind bore 62.

Figure 2:
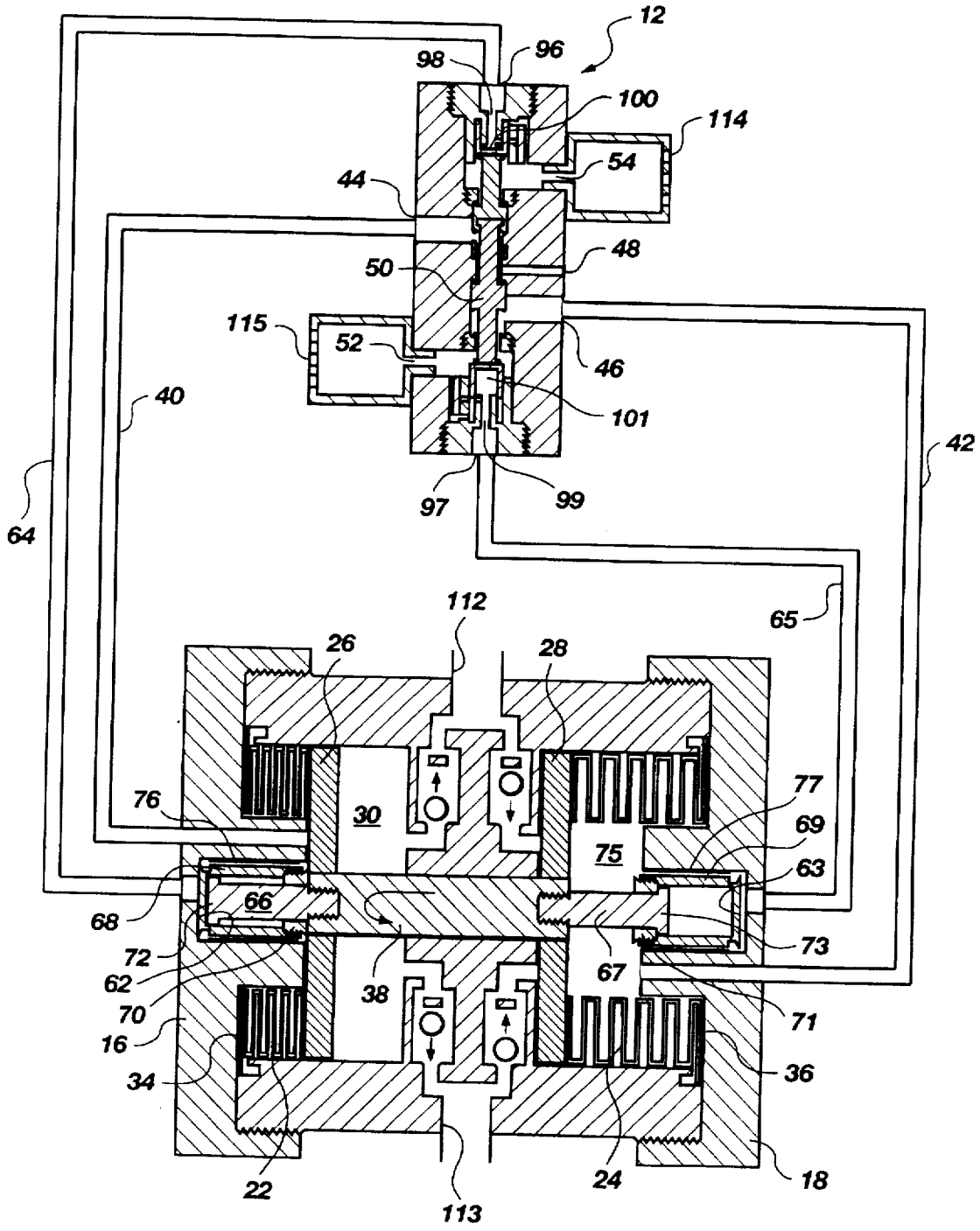
FIG. 2 is a schematic drawing similar to FIG. 1, illustrating the pump and spool valve in the second stage of the cycle.

Immediately before the pumping pistons 26, 28 reach the end of their leftward pumping cycle (FIG. 2), the head 73 on the right shifting piston 67 contacts the inside of the right canister cap 71, causing the right canister to "shift" slightly to the left with the shifting piston, approximately 1/16 inch. The right canister 69 therefore uncovers the port to the right shift line 65 and unseals the right canister face from the end of the right pump head blind bore 63, permitting pressurized air in the right bellows chamber 75 to begin to escape through the right canister shift air passageway 77, the right shift line 65, into the lower spool valve shifting port 97, the lower shifting duct 99, and into the lower push cap chamber 101, where it "blasts" the valve spool 50 to its upper position. This "shifts" the spool valve and fluid pump to their second stage or cycle, as is shown in FIG. 2. In addition, the bellows chamber pressurized air escaping from the right bellows chamber 75 drops the pressure slightly, immediately prior to the spool valve shift, thereby lowering the force with which the pumping pistons impact the pump body and heads at the ends of their strokes. This reduces end-of-stroke slamming and greatly increases pump component life. In addition, the drop in bellows chamber pressure near the end of each pump stroke reduces surge in the discharge liquid that would otherwise vibrate the lines and result in unnecessary abrasion, flexure, and fatigue in the lines, and would also tend to vibrate the fluid connections and fittings loose near the pump. In certain applications, surge can dislodge particulate contamination within fluid filters and reintroduce this contamination into the fluid system. The fluid pump shifting mechanism of the present invention minimizes the chances of this happening.

Again referring to FIG. 5, any residual air in the spool valve upper shifting duct 98 bleeds through the upper exhaust bleed orifice 108 and out the right exhaust port 54 as the valve spool 50 is shifted to its upper position. Because of the restrictive orifice effect of the spool valve lower exhaust bleed orifice 109, the initial blast of pressurized air into the spool valve lower shifting duct 99 is forced into the larger lower push cap chamber 101 to shift the spool 50 from its lower position to its upper position, before the pressurized air is permitted to "bleed" to exhaust through the lower restrictive exhaust bleed orifice 109 and left exhaust port 52.

At this point (FIG. 2), the left bellows 22 is essentially compressed. With the valve spool 50 in its upper position, high pressure air through the inlet port 48 is now directed to the left air supply port 44, through the left air supply line 40, and into the left bellows chamber 74. Air pressure within the left bellows chamber 74 shifts the left shifting canister 68 to the left, sealing the interior of the left bellows chamber from the left shift line 64. With the left bellows chamber 74 sealed, it begins to fill under pneumatic pressure to expand, urging both fluid pumping pistons 26, 28 to the right. This is the pressure stroke of the left bellows 22 and exhaust stroke of the right bellows 24. The more back-pressure from the pumped liquid, the tighter the seal becomes between the left shifting canister 68 and the end of the left pump head blind bore 62.

Figure 3:
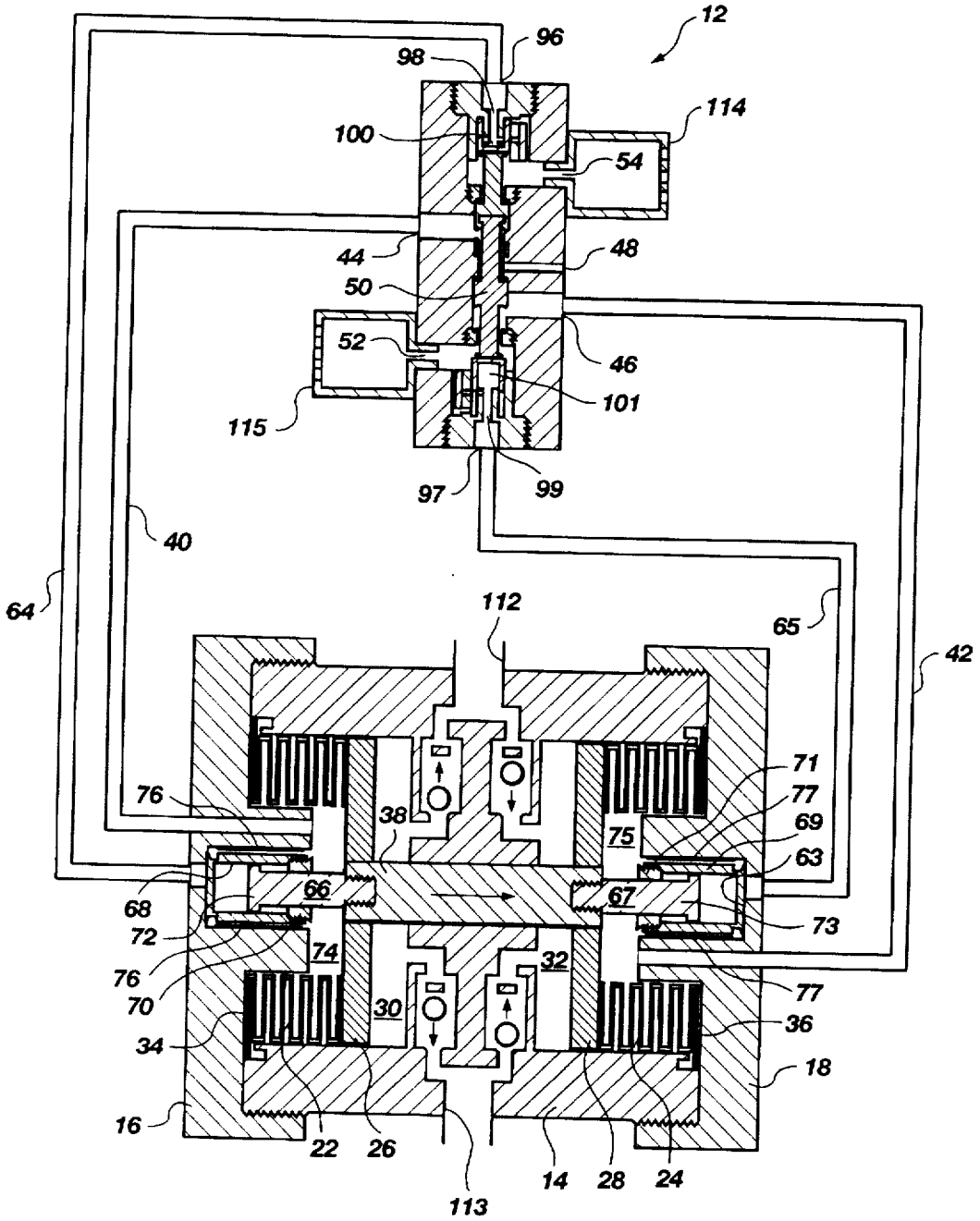
FIG. 3 is a schematic drawing similar to FIGS. 1 and 2, illustrating the pump and spool valve in the third stage of the cycle.

As shown in FIG. 3, rightward movement of the left fluid pumping piston 26 evacuates (pumps) fluid from the left fluid pumping chamber 30, and out the fluid pump exhaust 112. Rightward movement of the right fluid pumping piston 28 draws fluid into the right fluid pumping chamber 32 via the fluid pump intake 113. Rightward movement of the right fluid pumping piston 28 also evacuates the right bellows chamber 75 through the right air supply line 42, the spool valve right air supply port 46, through the spool valve, out the left exhaust port 52, and through the left muffler 115 to atmosphere. The pressurization of exhaust air in the right bellows chamber 75 created by rightward movement of the right bellows 24 shifts the right shift canister 69 to the right to seal against the right pump head blind bore 63.

Figure 4:
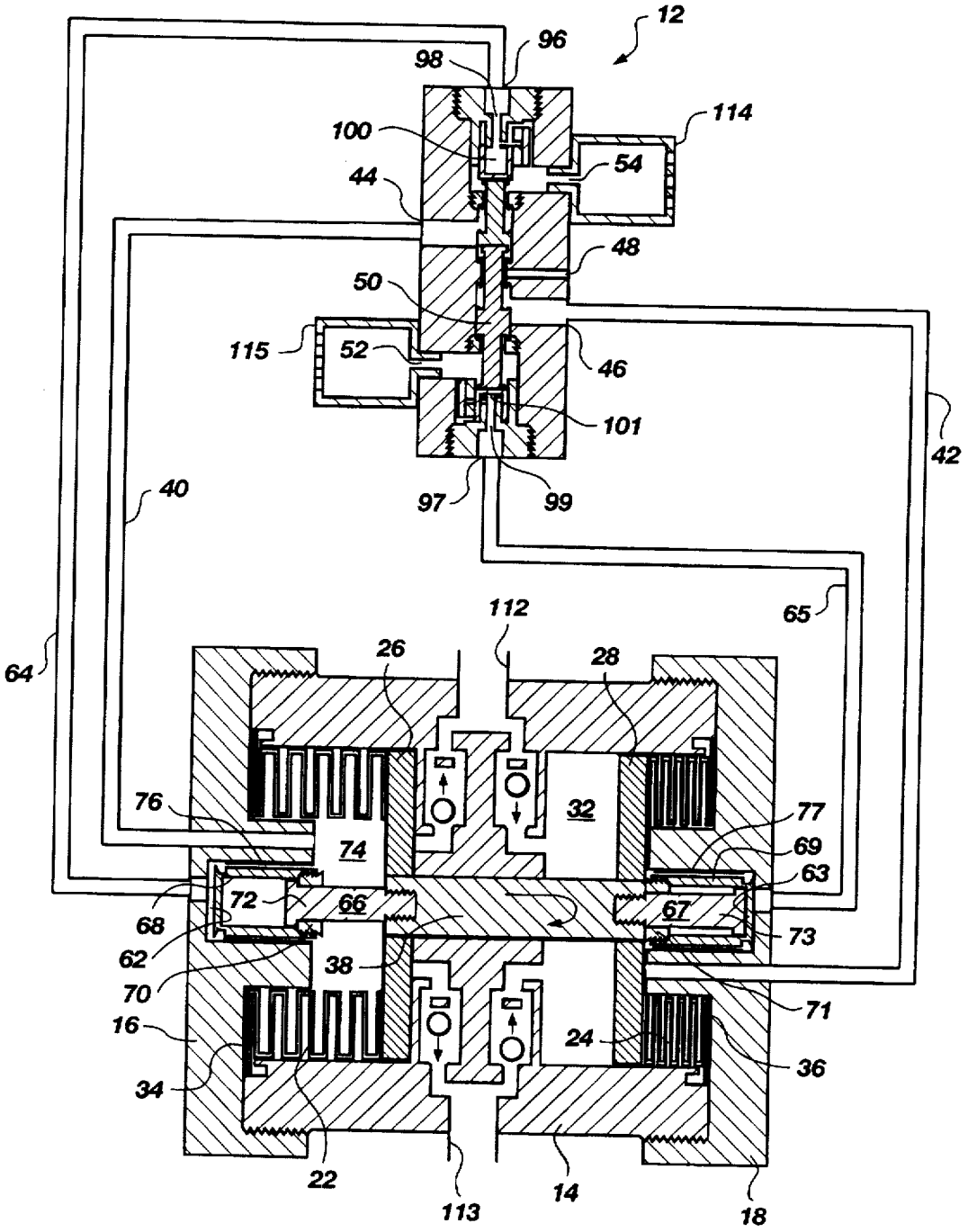
FIG. 4 is a schematic drawing similar to FIGS. 1–3, illustrating the pump and spool valve in the fourth stage of the cycle.
Figure 5:
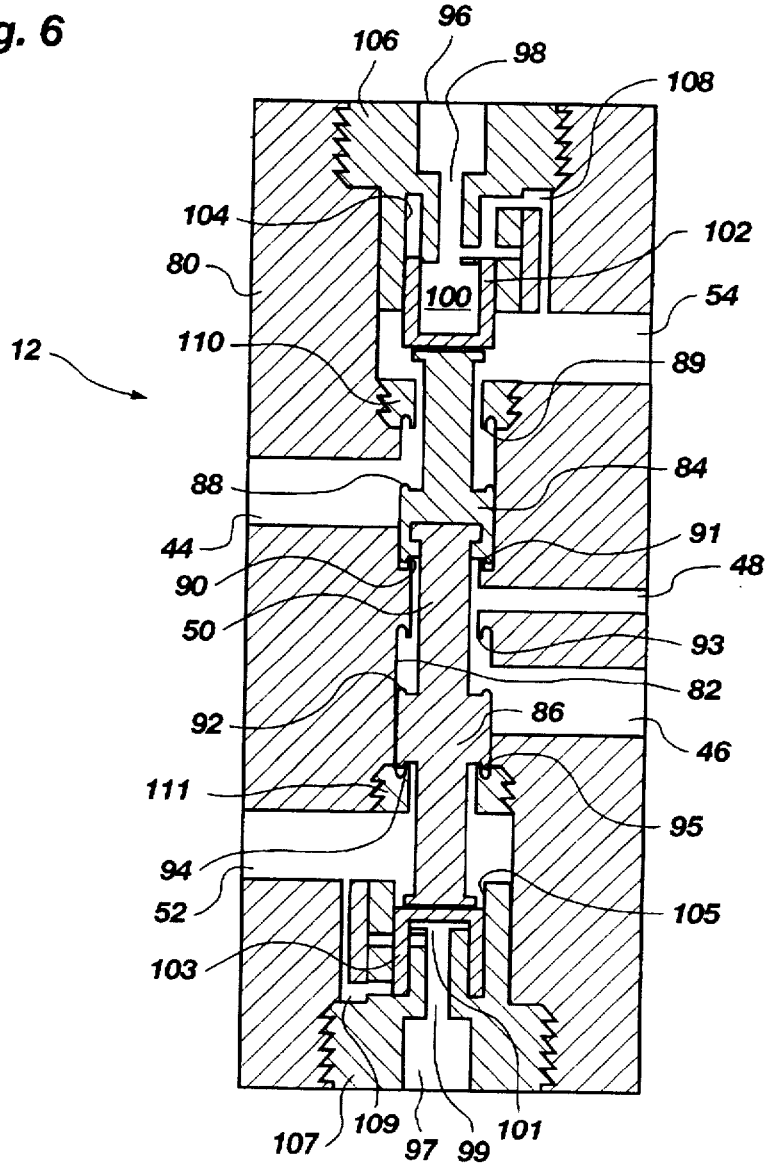
FIG. 5 is a sectional view of the reciprocating spool valve used with the fluid pump shifting mechanism of the present invention.

Immediately before the pumping pistons 26, 28 reach the end of their rightward pumping cycle (FIG. 4), the head 72 on the left shifting piston 66 contacts the inside of the left canister cap 70, causing the left canister to "shift" slightly to the right with the shifting piston, approximately 1/16 inch. The left canister 68 therefore uncovers the port to the left shift line 64 and unseals the left canister face from the end of the left pump head blind bore 62, permitting pressurized air in the left bellows chamber 74 to begin to escape through the left canister shift air passageway 76, the left shift line 64, into the upper spool valve shifting port 96, the upper shifting duct 98, and into the upper push cap chamber 100, where it "blasts" the valve spool 50 to its lower position. This "shifts" the spool valve and fluid pump back to their first stage or cycle, as is shown in FIGS. 1, 4, and 5. In addition, the bellows chamber pressurized air escaping from the left bellows chamber 74 drops the pressure slightly, immediately prior to the spool valve shift, thereby lowering the force with which the pumping pistons impact the pump body and heads at the ends of their strokes. This reduces end-of-stroke slamming and greatly increases pump component life.

Referring again to FIG. 5, any residual air in the spool valve lower shifting duct 99 bleeds through the lower exhaust bleed orifice 109 and out the left exhaust port 52 as the valve spool 50 is shifted to its lower position. Because of the restrictive orifice effect of the spool valve upper exhaust bleed orifice 108, the initial blast of pressurized air into the spool valve upper shifting duct 98 is forced into the larger upper push cap chamber 100 to shift the spool 50 from its upper position to its lower position, before the pressurized air is permitted to "bleed" to exhaust through the upper restrictive exhaust bleed orifice 108 and right exhaust port 54.

The purpose of these two restrictive air bleed orifices 108, 109 is to effect a drop in air pressure applied to each end of the valve spool as the valve spool nears the end of each respective operative stroke. This reduction in air pressure near the end of the operative stroke permits air in the opposite chamber adjacent the spool port to provide a cushioning effect to the valve spool and push cap to prevent the valve spool from slamming against the sealing ends of the spool valve body.

It will be appreciated that the present invention offers a number of improvements over pneumatically actuated dual reciprocating fluid pumps of the prior art. In the pump of the present invention, pneumatic pressure for shifting the reciprocating valve spool is taken from the pressure side, or pressure stroke, of the bellows pumping cycle. This has a number of advantages over prior art pneumatically actuated fluid pumps. Specifically, taking pneumatic pressure from the bellows pumping stroke permits the bellows chamber to begin to bleed air pressure therefrom, a predetermined amount prior to the end of the physical stroke of the bellows and fluid pumping pistons. This has a cushioning effect at the end of each fluid pumping piston stroke by reducing the pneumatic pumping pressure slightly, immediately prior to the shift of the actuation pneumatic pressure from one bellows chamber to the other.

The fit between the shifting piston and canister is sufficiently loose that a small amount of pressurized air is permitted to bleed between the piston and canister. This has the effect of further dropping the shifting air pressure in the bellows near the end of the mechanical stroke of each fluid pumping piston. This results in further reducing the pneumatic pumping pressure, immediately prior to the shift of the actuation pneumatic pressure from one bellows chamber to the other, thereby minimizing "slamming" of each bellows and fluid pumping piston into the fluid check valve mechanism in the center of the fluid pump.

In addition, the opposite shifting piston and canister mechanism is under a controlled air pressure resistance as air is permitted to bleed from the canister through the respective spool valve restrictive exhaust bleed orifice, thereby providing an air pressure cushioning or air brake effect which also helps slow the piston and bellows travel near the end of the stroke, in order to eliminate, or at least reduce, detrimental effects of the piston's positive shifting into the reverse direction at the end of its stroke. This elimination or reduction of the piston's slamming into the fluid pump housing central section and the bellows' being over compressed results in much smoother shifting and reciprocation of the fluid pumping pistons within the pump, and also reduced wear and fatigue on the pump components. In addition, the air cushion or air braking effect provided by both the pressure stroke bellows chamber's releasing air pressure toward the end of its stroke, and the back pressure provided by the exhaust stroke bellows chamber's controlled air pressure bleed therefrom, virtually eliminates fluid surge in the pump.

Certain applications of reciprocating fluid pumps dictate that the pump (or at least all surfaces exposed to the pumped fluid) be constructed totally of a fluropolymer or other fluroplastic materials that are not susceptible to chemical damage. The fluid pump of the present invention is designed to be constructed entirely of a fluropolymer or other soft material which does not require lubrication. In addition, certain components may be constructed of metal or other harder materials, as in many conventional pumps.

Deadhead is eliminated in the arrangement of the present invention, by virtue of the fact that there is always the flow of pressurized air through the spool valve to the reciprocating pump.

Because the spool valve is shifted by the pressurized air blast through the shift canister shift air passageways, the valve spool cannot shift until the pump piston diaphragm reaches the end of its stroke. Solids and particle contamination in the air supply cannot prematurely trip mechanical or electronic spool valve switches because there are none. Therefore, premature spool shifting cannot occur, and spool valve deadhead is eliminated.

From the foregoing, it will be seen that this invention is one well adapted to attain all of the ends and objectives herein set forth, together with other advantages which are obvious and which are inherent to the apparatus. It will be understood that certain features and subcombinations are of utility and may be employed with reference to other features and subcombinations. For instance, pressurized shift air from the pump shifting piston and canister mechanism can be applied to a pressure-actuated electrical switch, which then supplies an electrical pulse to an electrically actuated shuttle or spool valve for reciprocating the pressurized air between respective bellows chambers. This is contemplated by and is within the scope of the claims. As many possible embodiments may be made of the invention without departing from the scope of the claims. It is to be understood that all matter herein set forth or shown in the accompanying drawings is to be interpreted as illustrative and not in a limiting sense.

What is claimed is:

1. A pneumatically shifted reciprocating fluid pump comprising:

a body defining a plurality of pumped fluid pumping chambers;

driving means defining a pneumatically driven driving chamber associated with each respective pumped fluid pumping chamber;

connecting means connecting respective driving means;

a control valve for supplying a drive fluid sequentially to each pneumatically driven driving chamber for effecting reciprocal pumping of the respective driving means; and pneumatically actuated pneumatic switching means associated with each respective driving means for permitting drive fluid to selectively exhaust from respective pneumatically driven driving chambers near the end of each stroke of the respective driving means, to shift the control valve for sequentially supplying the drive fluid to respective pneumatically driven driving chambers for reciprocally actuating respective pumping means, the pneumatic switching means comprising:

a canister reciprocally moveable within a respective pump driving chamber and adapted to seal on an end of the canister against the pump body; and a piston connected to each respective pumping means at a respective first end of each piston, and adapted to reciprocate within a respective canister to shift said respective canister.

2. A pneumatically shifted reciprocating fluid pump as set forth in claim 1, wherein the pneumatic switching means piston shifts the canister when the fluid pump driving means approaches the end of its stroke.

3. A pneumatically shifted reciprocating fluid pump as set forth in claim 1, wherein the fit between the pneumatic switching means piston and canister is loose.

4. A pneumatically shifted reciprocating fluid pump as set forth in claim 1, wherein the pneumatic switching means canister includes a plurality of drive fluid relief passageways.

5. A pneumatically shifted reciprocating fluid pump as set forth in claim 1, wherein the pneumatic switching means canister loosely fits within the pump driving chamber.

6. A pneumatically shifted reciprocating fluid pump as set forth in claim 1, wherein the driving means comprises a piston, and the pneumatically driven driving chamber comprises a bellows.

7. A pneumatically shifted reciprocating fluid pump as set forth in claim 1, wherein the control valve is pneumatically actuated.

8. A pneumatically shifted reciprocating fluid pump as set forth in claim 1, wherein the control valve is physically separate from the fluid pump body.

9. A pneumatically shifted reciprocating fluid pump comprising:

a body defining a plurality of pumped fluid pumping chambers;

driving means defining a pneumatically driven driving chamber associated with each of the respective pumped fluid pumping chambers;

connecting means connecting respective driving means;

a pneumatically actuated control valve for supplying a drive fluid sequentially to each pneumatically driven driving chamber for effecting reciprocal pumping of the respective driving means; and pneumatically actuated pneumatic switching means associated with each of the respective driving means for permitting drive fluid to selectively exhaust from respective pneumatically driven driving chambers near the end of each stroke of the respective driving means, to shift the control valve for sequentially supplying the drive fluid to respective pneumatically driven driving chambers for reciprocally actuating respective pumping means, the pneumatic switching means comprising:

a canister reciprocally moveable within a respective pump driving chamber and adapted to seal on an end of the canister against the pump body; and a piston connected to each respective pumping means at a respective first end of each piston, and adapted to reciprocate within a respective canister to shift said respective canister.

the canister being slidably connected to the piston so that when the pumping means and piston approaches the end of their stroke, the piston shifts the canister to unseat from the pump body seal to relieve pressurized drive fluid from the respective driving chamber.

10. A pneumatically shifted reciprocating fluid pump as set forth in claim 9, wherein the fit between the pneumatic switching means piston and canister is loose.

11. A pneumatically shifted reciprocating fluid pump as set forth in claim 9, wherein the pneumatic switching means canister includes a plurality of drive fluid relief passageways.

12. A pneumatically shifted reciprocating fluid pump as set forth in claim 9, wherein the pneumatic switching means canister loosely fits within the pump driving chamber.

13. A pneumatically shifted reciprocating fluid pump as set forth in claim 9, wherein the driving means comprises a piston, and the pneumatically driven driving chamber comprises a bellows.

14. A pneumatically shifted reciprocating fluid pump as set forth in claim 9, wherein the control valve is pneumatically actuated.

15. A pneumatically shifted reciprocating fluid pump as set forth in claim 9, wherein the pneumatically actuated control valve is physically separate from the fluid pump body.

16. A pneumatically shifted reciprocating fluid pump comprising:

a body defining a plurality of pumped fluid pumping chambers;

driving means defining a pneumatically driven driving chamber associated with each respective pumped fluid pumping chamber;

connecting means connecting respective driving means;

a control valve for supplying a drive fluid sequentially to each pneumatically driven driving chamber for effecting reciprocal pumping of the respective driving means; and pneumatically actuated pneumatic switching means associated with each respective driving means for permitting drive fluid to selectively exhaust from respective pneumatically driven driving chambers near the end of each stroke of the respective driving means, to shift the control valve for sequentially supplying the drive fluid to respective pneumatically driven driving chambers for reciprocally actuating respective pumping means, the pneumatic switching means comprising:

a canister reciprocally moveable within a respective pump driving chamber and adapted to seal on an end of the canister against the pump body; and a piston connected to each respective pumping means at a respective first end of each piston, and adapted to reciprocate within a respective canister to shift said respective canister.

wherein fluid sealing between the canister and pump driving chamber is not around the circumference of the canister.

17. A pneumatically shifted reciprocating fluid pump comprising:

a body defining a plurality of pumped fluid pumping chambers;

driving means defining a pneumatically driven driving chamber associated with each respective pumped fluid pumping chamber;

connecting means connecting respective driving means;

a control valve for supplying a drive fluid sequentially to each pneumatically driven driving chamber for effecting reciprocal pumping of the respective driving means; and pneumatically actuated pneumatic switching means associated with each respective driving means for permitting drive fluid to selectively exhaust from respective pneumatically driven driving chambers near the end of each stroke of the respective driving means, to shift the control valve for sequentially supplying the drive fluid to respective pneumatically driven driving chambers for reciprocally actuating respective pumping means, the pneumatic switching means comprising:

a canister reciprocally moveable within a respective pump driving chamber and adapted to seal on an end of the canister against the pump body; and a piston connected to each respective pumping means at a respective first end of each piston, and adapted to reciprocate within a respective canister to shift said respective canister;

wherein fluid sealing between the canister and pump driving chamber is on an end of the canister.

* * * * *